US005534199A

United States Patent [19]

Winkler, III

[11] Patent Number: 5,534,199

[45] Date of Patent: Jul. 9, 1996

[54] VEHICLE WASH DETERGENT/FOAM AND METHOD

[76] Inventor: J. A. Winkler, III, 201 S. Locksley Dr., Lafayette, La. 70508

[21] Appl. No.: 532,094

[22] Filed: Sep. 22, 1995

[51] Int. Cl.[6] ..... C11D 1/83; C11D 1/94

[52] U.S. Cl. ..... 510/242; 134/42; 510/423; 510/425; 510/429; 510/433

[58] Field of Search ..... 252/546, 550, 252/553, 544, 174.21; 134/42

[56] References Cited

U.S. PATENT DOCUMENTS

| | | | |
|---|---|---|---|
| 4,102,825 | 7/1978 | Murata et al. | 252/547 |
| 5,102,573 | 4/1992 | Han et al. | 252/153 |
| 5,108,660 | 4/1992 | Michael | 252/545 |
| 5,362,422 | 11/1994 | Masters | 252/544 |
| 5,389,304 | 2/1995 | Repinec, Jr. et al. | 252/546 |

*Primary Examiner*—Paul Lieberman
*Assistant Examiner*—Michael P. Tierney

[57] ABSTRACT

A method of producing a vehicle wash detergent/foam for cleaning cars, trucks and other vehicles using commercial vehicle washing equipment, which comprises the step of producing a vehicle wash detergent/foam concentrate solution comprising water as the suspending solvent; dodecyl benzene sulfonic acid as a detergent/foam agent; monoethanolamine, or diethanolamine, or triethanolamine as modifying substance to adjust the pH of the solution just to the base side of 7.0 and simultaneously form the amine salt of the dodecyl benzene sulfonic acid; either a 1:1 cocoamide DEA or a 2:1 cocoamide DEA as a detergent/foam agent; either sodium lauryl sulfate or an alpha olefin sulfonate as a detergent/foam agent; coco-dimethylamidopropyl betaine as a foam agent; propylene glycol as a solvent; either a 9-molar ethoxylated secondary alcohol or a 9-molar ethoxylated nonyl phenol as a surfactant; and monoethanolamine, or diethanolamine, or triethanolamine as an oil solubilizing agent. A vehicle wash detergent/foam solution is produced from the concentrate solution by introducing the detergent/foam concentrate solution to a stream of water through spray nozzles associated with the vehicle washing equipment.

11 Claims, No Drawings

VEHICLE WASH DETERGENT/FOAM AND METHOD

FIELD OF INVENTION

The present invention generally relates to the field of commercial vehicle wash products and more particularly relates to a new composition for producing an environmentally and personally safe-to-use vehicle wash detergent and foam product.

BACKGROUND OF INVENTION

A vehicle wash detergent with high foaming characteristics has been developed which provides excellent cleaning capabilities when used in small quantities in automated vehicle wash equipment as typically found at auto and truck service stations. The product is unique in that it does not require the wax cycle which follows wash and rinse cycles in automated systems. The product prevents the formation of water spotting on vehicles, a feature that other detergent/wax systems utilize the wax cycle to prevent.

SUMMARY OF INVENTION

The invention of the present composition and method is designed to satisfy the aforementioned needs. It provides a vehicle wash detergent/foam concentrate comprising detergents, foam producing components, surfactants, oil solubilizers, acid neutralizers, and solvents which is combined with water through a metering system to produce a vehicle wash detergent/foam solution. The vehicle wash detergent/foam produced by the composition and method provides characteristics which are sought after in the vehicle wash industry including the characteristics of excellent cleaning, excellent foam stability, minimal water spotting upon drying, elimination of the need for a car wax cycle in the cleaning process, and minimal impact on the associated waste water disposal system.

The composition and method of the present invention provides a vehicle wash detergent/foam which is environmentally safe, non-hazardous and biodegradable. The product leaves no residue and will not adversely affect soil bacteria, wastewater bacteria, or animal and marine life.

The composition and method of the present invention provides a vehicle wash detergent/foam which may be utilized with existing commercial vehicle wash equipment, such as tanks, hoses, pumps and nozzles, and which will reduce the likelihood of corrosion and equipment damage associated with conventional vehicle wash detergent/foams.

The composition and method of the present invention provides a vehicle wash detergent/foam which will not require special equipment for its use or special cleanup measures and equipment after the product is used.

The composition and method of the present invention provides a vehicle wash detergent/foam which contains no heavy metals, phosphates, or chlorides.

The composition and method of the present invention provides a vehicle wash detergent/foam which provides an advantage over conventional and currently used products. The detergent/foam of the present invention requires no special containment or disposal procedures because the detergent/foam does not contain components which are regulated for discharge.

The detergent/foam of the present invention will reduce the cost associated with waste disposal because the detergent/foam itself is non-hazardous, non-corrosive and non-caustic. The foam is free of heavy metals, phosphates, and chlorides and contains no abrasive or reactive chemicals.

DETAILED DESCRIPTION OF PREFERRED EMBODIMENT

In general, the composition of the present invention is a vehicle wash detergent/foam concentrate solution comprising the combination of the following components:

(1) Dodecyl benzene sulfonic acid, CAS 68584-22-5, as a detergent and foam producing agent;

(2) Either monoethanolamine, CAS 141-43-5, diethanolamine, CAS 11-42-2, or triethanolamine, CAS 102-71-6, to adjust the pH of the solution just to the base side of neutrality, that is, pH 7.0, and to act as an oil solubilizer;

(3) A $C_8$–$C_{18}$ fatty acid amide (either monoethanolamine or diethanolamide) having either a 1:1 or 2:1 ratio of free amine to fatty acid; such as 1:1 cocoamide diethanolamide (herein referred to as cocoamide DEA) or a 1:1 cocoamide monoethanolamine (herein referred to as cocoamide MEA) or a 2:1 cocoamide DEA or a 2:1 cocoamide MEA;

(4) Sodium lauryl sulfate, CAS 151-21-3, or an alpha olefin sulfonate CAS 68439-57-6 as a detergent and foam producing agent;

(5) A coco-dimethylamidopropyl betaine, CAS 61789-40-0, as foam producing agent;

(6) A poly-ethoxylated secondary alcohol, or a poly-ethoxylated nonyl phenol as a surfactant;

(7) Propylene glycol, CAS 57-55-6, as a solvent; and (8) Water as a dilutant.

Preferably the components are mixed and stirred at a constant rate in a glass-lined mixing vessel with a three-bladed (marine style) mixer impeller, though other types of vessels and mixing methods may be utilized.

EXAMPLE 1

As an illustrative example, applicant's invention was prepared in the following order of components and in the following quantities. Water in the amount of 34.05 kg and triethanolamine (99%) in the amount of 2.33 kg were added to a vessel with continuous stirring. Then with further stirring, 5.10 kg dodecyl benzene sulfonic acid was added to form the amine salt of the dodecyl benzene sulfonic acid. Additional triethanolamine (99%) was then added to the mixture in an amount sufficient to adjust the pH of the mixture to be on the base side of neutrality, specifically at or above pH 7.0.

Then, while the mixture was continuously stirred, the following components were successively added: [a] 0.94 kg of a 1:1 cocoamide DEA (82% in water); [b] 0.45 kg of coco-dimethylamidopropyl betaine (37%); [c] 0.52 kg of sodium lauryl sulfate (28%); [d] 0.42 kg of propylene glycol; [e] 0.46 kg of diethanolamine (85%); 0.06 kg of a 9-molar ethoxylated secondary alcohol, CAS 68131-40-8. Sufficient dye was then added to cause the color of the resultant mixture to be a more pleasing desired color instead of its usual yellow coloration. The mixture was stirred until the mixture was homogeneous and all of the components were in solution.

Example 1, when combined in the described manner, produces a vehicle wash detergent/foam concentrate having the following component percentages: 76.80% water, 11.50% dodecyl benzene sulfonic acid, 5.26% triethanolamine (99%), 2.12% 1:1 cocoamide DEA (82% in water), 1.02% coco-dimethylamidopropyl betaine (37% in water), 1.16% sodium lauryl sulfate (28% in water), 0.96% propylene glycol, 1.04% diethanolamine (85% in water), 0.14% of a 9-molar ethoxylated secondary alcohol.

The vehicle wash detergent/foam concentrate so produced is used to produce a vehicle washing foam by metering the concentrate into a water stream produced in commercial vehicle washing equipment in a ratio of about 1 part concentrate to about 100 to 300 parts water during the vehicle wash cycle. The washing foam produced with the detergent/foam concentrate may be then applied to the vehicle being washed by brushes and by spraying depending upon the type of washing equipment being utilized. The washing foam is removed from the vehicle by a fresh water rinse. The resultant washing foam and rinse water can be safely introduced into the waste water system at the vehicle wash facility or foam and rinse water may be recycled if the vehicle wash facility has water recycle capability.

EXAMPLE 2

As another illustrative example of the composition of applicant's invention, 0.94 kg of a 2:1 cocoamide DEA (82% in water) was substituted for the 1:1 cocoamide DEA as one of the foam producing agents in the above described Example 1.

EXAMPLE 3

As another illustrative example of the composition of applicant's invention, monoethanolamine (99% in water) was used to adjust the pH of the solution just to the base side of 7.0, rather than the triethanolamine of Example 1.

EXAMPLE 4

As another illustrative example of the composition of applicant's invention, diethanolamine (85% in water) was used to adjust the pH of the solution just to the base side of 7.0, rather than the triethanolamine of Example 1.

EXAMPLE 5

As another illustrative example of the composition of applicant's invention, a 9-molar ethoxylated nonyl phenol, CAS 9016-45-9, was substituted for the 9-molar ethoxylated secondary alcohol as the surfactant as listed in Example 1. It is thought that poly-ethoxylated nonyl phenols and poly-ethoxylated secondary alcohols having from four moles to eleven moles of ethoxylation may be substituted for the 9-molar products.

EXAMPLE 6

As still another example of the composition of applicant's invention, 0.15 kg of an alpha olefin sulfonate (dissolved in 0.37 kg of water) was used in place of sodium lauryl sulfate (28% in water) as a foam producing agent and detergent of Example 1.

EXAMPLE 7

As still another illustrative example of the composition of applicants invention, it is thought that a car wash detergent/foam concentrate solution having the qualities described herein may be produced when the above enumerated components are combined in the above described manner and in the following range of quantities:

(a) About 30 kg to 40 kg of water as a diluting solvent;

(b) 4.0 kg to 6.0 kg of dodecyl benzene sulfonic acid, CAS 68584-22-5, as a detergent and foam producing agent;

(c) Either monoethanolamine, CAS 141-43-5, diethanolamine, CAS 111-42-2, or triethanolamine, CAS 102-71-6, in an amount sufficient to adjust the pH of the solution to the base side of neutrality, that is greater than pH 7.0, when the quantity of dodecyl benzene sulfonic acid is added;

(d) Either 0.8 kg to 1.1 kg of a 1:1 cocoamide DEA, CAS 68603-42-9, or a 2:1 cocoamide DEA as a detergent and foam producing agent;

(e) 0.3 kg to 0.8 kg of coco-dimethylamidopropyl betaine (37% in water), CAS 61789-40-0, as a foam producing agent;

(f) Either 0.3 kg to 0.8 kg of sodium lauryl sulfate (28%), CAS 151-21-3, or 0.1 kg (in 0.3 kg of water) to 0.2 kg (in 0.5 kg of water) of an alpha olefin sulfonate as a detergent and foam producing agent;

(g) 0.3 to 0.7 kg of propylene glycol, CAS 57-55-6, as a solvent;

(h) 0.3 kg to 0.7 kg of either monoethanolamine, CAS 141-43-5, diethanolamine, CAS 111-42-2, or triethanolamine, CAS 102-71-6, as an oil solubilizing agent;

(i) 0.05 kg to 0.07 kg of either a 9-molar ethoxylated secondary alcohol, CAS 68131-40-8, or a 9-molar ethoxylated nonyl phenol, CAS 9016-45-9, as a surfactant.

Example 7, when combined in the described manner, produces a vehicle wash detergent/foam concentrate having the following component percentages: 67.0–90.0% water; 9.0–14.0% dodecyl benzene sulfonic acid; either monoethanolamine, diethanolamine, or triethanolamine in an amount sufficient to adjust the pH of the solution to the base side of neutrality when the quantity of dodecyl benzene sulfonic acid is added; 1.8 to 2.5% of either a 1:1 cocoamide DEA or 1:1 cocoamide MEA or a 2:1 cocoamide DEA or a 2:1 cocoamide MEA; 0.9–1.4% coco-dimethyl amidopropyl betaine (37% in water); 0.9 to 1.4% sodium lauryl sulfate (28% in water) or 0.1 to 0.4% alpha olefin sulfonate; 0.6 to 1.6% propylene glycol; 0.6 to 1.6% either monoethanolamine, diethanolamine or triethanolamine as an oil solubilizing agent; and 0.1 to 0.3% of an ethoxylated secondary alcohol.

The vehicle wash detergent/foam concentrate produced from each of the examples set forth herein may be utilized in most commercial vehicle washing equipment in the manner describe in Example 1. An application of wax in a wax cycle of the car washing sequence is not typically necessary when the detergent/wash concentrate is utilized in automatic vehicle washing equipment. The resulting wash and rinse water produced at the washing facility after use of the wash detergent/foam concentrate is non-hazardous and biodegradable and can be safely introduced into the waste water system at the vehicle wash facility.

The vehicle wash detergent/foam produced from the examples set forth herein may be used with all types of commercial car and truck wash equipment. The quantities utilized in the examples may be changed provided the ratio of the various components to the whole remains the same. It is thought that the detergent/foam produced from the concentrates described herein will be safe, fully biodegradable, and not adversely affect soil bacteria, waste water bacteria, marine life, animals, grass or plants. It is also thought that the vehicle wash detergent/foam produced from the concentrates described herein will not damage roadways or driveways, metal, wood or painted surfaces any more than would potable water.

It is thought that the vehicle wash detergent/foam and method of the present invention and many of its attendant advantages will be understood from the foregoing descriptions and it will be apparent that various changes or modifications may be made to the examples presented without departing from the spirit and scope of the invention or sacrificing all of its material advantages, the form described herein being merely a preferred or exemplary embodiment of the invention.

I claim:

1. A vehicle wash detergent/foam concentrate solution for use in automated vehicle washing equipment comprising:

(a) 67.0–90.0% water as a diluting solvent;

(b) 9.0–14.0% dodecyl benzene sulfonic acid as a detergent and foam producing agent;

(c) a pH-modifying substance in an amount sufficient to establish the resulting solution on the base side of neutrality, specifically a pH greater than 7.0, selected from the group consisting of monoethanolamine, diethanolamine, and triethanolamine; wherein the pH-modifying substance is present in an amount of at least about 0.5%;

(d) 1.8–2.5% of a fatty acid amide selected from the group consisting of a 2:1 cocoamide DEA (82% in water), a 1:1 cocoamide DEA (82% in water), 2:1 cocoamide MEA (82% in water), and 1:1 cocoamide MEA (82% in water), as a detergent and foam producing agent;

(e) 0.9–1.4% coco-dimethylamidopropyl betaine as a foam producing agent;

(f) 0.9–1.4% sodium lauryl sulfate as a detergent and foam producing agent;

(g) 0.6–1.6% propylene glycol as a solvent;

(h) 0.1–0.3% of a surfactant selected from the group consisting of a poly-ethoxylated secondary alcohol, and a poly-ethoxylated nonyl phenol.

2. A method of producing a vehicle wash detergent/foam for use in automated vehicle washing equipment, which comprises the step of producing a wash detergent/foam concentrate solution comprising:

(a) adding 34.05 kg of water to a mixing vessel as a suspending solvent;

(b) stirring said water and adding 2.33 kg of an acid neutralizing agent selected from the group consisting of monoethanolamine, diethanolamine, and triethanolamine, to said water to form a solution;

(c) stirring said solution and adding 5.10 kg of dodecyl benzene sulfonic acid as a detergent and foam producing agent to said solution;

(d) stirring said solution and adding additional quantities of said acid neutralizing agent in an amount sufficient to produce a resulting solution having a pH on the base side of neutrality;

(e) stirring said resulting solution and successively adding 0.94 kg of a fatty acid amide selected from the group consisting of a 2:1 cocoamide DEA (82% in water), 2:1 cocoamide MEA (82% in water), 1:1 cocoamide MEA (82% in water), and a 1:1 cocoamide DEA (82% in water); 0.45 kg of coco-dimethylamidopropyl betaine (37%); an anionic surfactant selected from the group consisting of 0.15 kg alpha olefin sulfonate dissolved in 0.37 kg water or 0.52 kg of sodium lauryl sulfate (28%); 0.42 kg of propylene glycol; 0.46 kg of diethanolamine (85%); and 0.06 kg of a surfactant selected from the group consisting of a 9-molar ethoxylated nonyl phenol and a 9-molar ethoxylated secondary alcohol, and (f) further stirring said resulting solution while adding sufficient dye to cause the color of said resulting solution to be a desired color and until said resulting solution is homogeneous with all components in solution.

3. A method of producing a vehicle wash detergent/foam for use in automated vehicle washing equipment, which comprises the step of producing a wash detergent/foam concentrate solution comprising the steps of:

(a) adding 35 kg to 45 kg of water to a mixing vessel as a suspending solvent;

(b) stirring said water and adding 2.33 kg of an acid neutralizing agent selected from the group consisting of monoethanolamine, diethanolamine, and triethanolamine, to said water to form a solution;

(c) stirring said solution and adding 4.0 kg to 6.0 kg of dodecyl benzene sulfonic acid as a detergent and foam producing agent to said solution;

(d) stirring said solution and adding additional quantities of said acid neutralizing agent in an amount sufficient to produce a resulting solution having a pH on the base side of neutrality;

(e) stirring said resulting solution and successively adding 0.8 kg to 1.1 kg of a fatty acid amide selected from the group consisting of a 2:1 cocoamide DEA (82% in water), 2:1 cocoamide MEA, (82% in water), 1:1 cocoamide MEA (82% in water), and a 1:1 cocoamide DEA (82% in water); between 0.4 kg to 0.7 kg of coco-dimethylamidopropyl betaine (37%); an anionic surfactant selected from the group consisting of 0.1 kg (dissolved in 0.2 kg of water) to 0.2 kg (dissolved in 0.5 kg of water) of alpha olefin sulfonate or 0.4 kg to 0.7 kg of sodium lauryl sulfate (28%); 0.4 kg to 0.6 kg of propylene glycol; 0.4 kg to 0.6 kg of diethanolamine (85%); and 0.05 kg to 0.07 kg of a surfactant selected from the group consisting of a 9-molar ethoxylated nonyl phenol and a 9-molar ethoxylated secondary alcohol, and (f) further stirring said resulting solution until said resulting solution is homogeneous with all components in solution.

4. A method of producing a vehicle wash detergent/foam for use in automated vehicle washing equipment as recited in claim 3, comprising the additional step of adding sufficient dye to said detergent/foam concentrate while stirring said resultant solution to cause the color of said resulting solution to be a desired color.

5. A method of producing a vehicle wash detergent/foam for use in automated vehicle washing equipment, which comprises the step of producing a wash detergent/foam concentrate solution comprising:

(a) 76.82% water as a diluting solvent;

(b) 11.50% dodecyl benzene sulfonic acid as a detergent and foam producing agent;

(c) a pH-modifying substance in an amount sufficient to establish the resulting solution on the base side of neutrality, specifically a pH greater than 7.0, selected from the group consisting of monoethanolamine, diethanolamine, and triethanolamine; wherein the pH-modifying substance is present in an amount of at least about 0.9%;

(d) 2.12% of a fatty acid amide selected from the group consisting of a 2:1 cocoamide DEA (82% in water) and a 1:1 cocoamide DEA (82% in water), as a detergent and foam producing agent;

(e) 1.01% coco-dimethylamidopropyl betaine as a foam producing agent;

(f) an anionic surfactant selected from the group consisting of 0.4% of an alpha olefin sulfonate or 1.16% sodium lauryl sulfate as a detergent and foam producing agent;

(g) 0.96% propylene glycol as a solvent;

(h) 0.13% of a surfactant selected from the group consisting of a poly-ethoxylated secondary alcohol and a poly-ethoxylated nonyl phenol.

6. A vehicle wash detergent/foam concentrate solution for use in automated vehicle washing equipment comprising:

(a) 76.82% water as a diluting solvent;

(b) 11.50% dodecyl benzene sulfonic acid as a detergent and foam producing agent;

(c) a pH-modifying substance in an amount sufficient to establish the resulting solution on the base side of neutrality, specifically a pH greater than 7.0, selected from the group consisting of monoethanolamine, diethanolamine, and triethanolamine; wherein the pH-modifying substance is present in an amount of at least about 0.9%;

(d) 2.12% of a fatty acid amide selected from the group consisting of a 2:1 cocoamide DEA (82% in water), 1:1 cocoamide DEA (82% in water), 2:1 cocoamide MEA (82% in water), and 1:1 cocoamide MEA (82% in water), as a detergent and foam producing agent;

(e) 1.01% coco-dimethylamidopropyl betaine as a foam producing agent;

(f) an anionic surfactant selected from the group consisting of 0.4% of an alpha olefin sulfonate or 1.16% sodium lauryl sulfate as a detergent and foam producing agent;

(g) 0.96% propylene glycol as a solvent;

(h) 0.13% of a surfactant selected from the group consisting of a poly-ethoxylated secondary alcohol and a poly-ethoxylated nonyl phenol.

7. A vehicle wash detergent/foam concentrate solution for use in automated vehicle washing equipment as recited in claim 6, wherein sufficient dye is added to said detergent/foam concentrate solution to cause the color of said resulting solution to be a desired color.

8. A method of producing a vehicle wash detergent/foam for use in automated vehicle washing equipment as recited in claim 3, further comprising the additional steps of:

(a) metering said detergent/foam concentrate solution into a stream of water in a ratio of 1 part of said concentrate solution to between 100 to 300 parts water;

(b) applying said concentrate solution and water stream to said vehicles; and (c) rinsing said concentrate solution and water stream from said vehicles.

9. A method of producing a vehicle wash detergent/foam as recited in claim 5 wherein, said surfactant is selected from the group consisting of a 9-molar ethoxylated secondary alcohol and 9-molar ethoxylated nonyl phenol.

10. A method of producing a vehicle wash detergent/foam for use in automated vehicle washing equipment, which comprises the step of producing a wash detergent/foam concentrate solution comprising:

(a) 67.0–90.0% water as a diluting solvent;

(b) 9.0–14.0% dodecyl benzene sulfonic acid as a detergent and foam producing agent;

(c) a pH-modifying substance in an amount sufficient to establish the resulting solution on the base side of neutrality, specifically a pH greater than 7.0, selected from the group consisting of monoethanolamine, diethanolamine, and triethanolamine; wherein the pH-modifying substance is present in an amount of at least about 0.5%;

(d) 1.8–2.5% of a fatty acid amide selected from the group consisting of a 2:1 cocoamide DEA (82% in water) and a 1:1 cocoamide DEA (82% in water), as a detergent and foam producing agent;

(e) 0.9–1.4% coco-dimethylamidopropyl betaine as a foam producing agent;

(f) 0.9–1.4% sodium lauryl sulfate as a detergent and foam producing agent;

(g) 0.6–1.6% propylene glycol as a solvent;

(h) 0.1–0.3% of a surfactant selected from the group consisting of a poly-ethoxylated secondary alcohol, and a poly-ethoxylated nonyl phenol.

11. A vehicle wash detergent/foam concentrate as recited in claim 6 wherein said surfactant is selected from the group consisting of a 9-molar ethoxylated secondary alcohol and a 9-molar ethoxylated nonyl phenol.

* * * * *